United States Patent [19]

Tanaka et al.

[11] 4,398,552

[45] Aug. 16, 1983

[54] APPARATUS FOR PICKLING THE INNER WALL OF TUBULAR MATERIAL

[75] Inventors: Yoshiro Tanaka; Noritsugu Fujii; Kazuo Akagi; Ryujiro Shitamatsu, all of Shimonoseki, Japan

[73] Assignee: Kabushiki Kaisha Kobe Seiko Shō, Kobe, Japan

[21] Appl. No.: 307,675

[22] Filed: Oct. 1, 1981

[30] Foreign Application Priority Data

Aug. 12, 1981 [JP] Japan ..... 56-127146

[51] Int. Cl.[3] ..... B08B 3/02

[52] U.S. Cl. ..... 134/57 R; 134/170

[58] Field of Search ..... 134/57 R, 113, 152, 134/170–171, 184

[56] References Cited

U.S. PATENT DOCUMENTS

| | | | |
|---|---|---|---|
| 2,714,079 | 7/1955 | Stodgell | 134/57 R X |
| 3,937,448 | 2/1976 | Fujii et al. | 134/170 X |
| 4,163,454 | 8/1979 | Shigeta | 134/57 R |

FOREIGN PATENT DOCUMENTS

| | | | |
|---|---|---|---|
| 1374498 | 4/1963 | France | 134/170 |
| 724084 | 2/1955 | United Kingdom | 134/152 |
| 492599 | 2/1976 | U.S.S.R. | 134/171 |

*Primary Examiner*—Robert L. Bleutge

*Attorney, Agent, or Firm*—Oblon, Fisher, Spivak, McClelland & Maier

[57] ABSTRACT

An apparatus for pickling the inner wall of a tubular member, for example, a zirconium or zircaloy tubular member as a cladding tube for nuclear fuel. The apparatus features the use of ultrasonic instruments for measuring the inner diameter of the tubular member while pickling the inner wall of the same. Owing to the interlocked association of the instruments and mechanism for supplying a pickling liquid into the tubular member, the supply of the pickling liquid can be stopped as soon as the inner diameter has reached a predetermined value. Various mechanisms may also be incorporated in the apparatus to minimize the temperature variation along the length of the tubular member and to improve the accuracy of the measurement by the instruments.

17 Claims, 19 Drawing Figures

APPARATUS FOR PICKLING THE INNER WALL OF TUBULAR MATERIAL

BACKGROUND OF THE INVENTION

1. Field of the Invention

This invention relates to an apparatus for subjecting the inner wall of a tubular member to pickling treatment, and more particularly, to an apparatus for subjecting the inner walls of a wide variety of metallic tubes led by zircaloy tubes as cladding tubes for nuclear fuel to pickling treatment.

2. Description of the Prior Art

It has been known to pickle the inner walls of various metallic tubes, represented by stainless steel tubes. Depending on materials forming such tubular member, certain tubular member are pickled one by one using home industrial methods. In the case of stainless steel tubes, it is of course possible to immerse several tubes together in an acidic solution and to subject both outer and inner walls thereof to a pickling treatment. However, where tubes are made of, for example, zirconium or a zirconium alloy, it is improper or difficult to conduct the above-described dipping treatment. Thus, subsequent to the final annealing of these zirconium or zirconium alloy tubes, only the outer surfaces are polished to a roughness factor, for example, of about 6 s or so. Then, their inner and outer surfaces are pickled using an acidic solution such as nitric acid, fluoric acid or the like so as to obtain mirror-finished final products. Accordingly, if such pipes are brought into standstill or mutual contact during their pickling operation, there is a danger that pits, dents, or other surface irregularities would be developed on the surfaces thereof. Following pickling operation, it is necessary to immediately dip the tubular members into a neutralizing solution. If the residence time of the tubular members in the neutralizing solution is too long, irregularities tend to occur on the surfaces of the tubular members. Since the thickness reduction of a tubular member by pickling treatment is generally designed to be on the order of about 20$\mu$ at the outer diameter thereof, it is generally impossible to pickle several tubular members at once in order to follow the above-described standard. Furthermore, even in the pickling step per se, the treatment time period is strictly specified where the pickling treatment is carried out in two steps using both strong acid and mild acid. Moreover, it is necessary to continuously treat the thus-pickled tubular members to the water-rinsing step. Unless these steps are carried out in a manner even slightly different from that specified, there is a potential danger that white spots develope during the final test in an autoclave. This final test is generally conducted by users of the tubular members. Thus, unless such tubular members are carefully finished before their shipping to users, serious claims would arise from such users with respect to the quality of the tubular members. For the reasons mentioned above, it has heretofore been necessary to treat such tubular members one by one.

In order to solve various problems as described above, the present assignee has proposed in the past pickling apparatus exclusively for the inner walls of tubular members as disclosed in Japanese Patent Publication No. 15809/1978 (now, Japanese Patent No. 955215) and Japanese Patent Laid-open No. 123565/1978, which are incorporated herein as references. Satisfactory results have been obtained through the use of such pickling apparatus. As a result of extensive research carried out by the present inventors, it has been found that the commercial utility of such apparatus would be further improved by the provision of a mechanism to adjust the thickness so as to be reduced through the pickling treatment. Thus, the present inventors have ingeneously conceived of the concept of incorporating in such apparatus an instrument for measuring the inner diameter of a tubular member while subjecting the same to pickling treatment.

An ultrasonic wave (i.e., probe sensor) may be used as such an instrument for the determination of the inner diameter of a tubular member. However, the present inventors have realized that, where the general ultrasonic inner diameter measurement technology which is applied in air is employed as is, serious problems would arise because of: (a) the heat to be developed by the chemical reaction between the acidic solution and the tubular material; (b) special working conditions, in other words, the measurement and control of the extent of pickling must be carried out while proceeding with pickling treatment; (c) the inner diameter of a tubular member tends to vary at certain points along the length of the tubular member; (d) correction of the inner diameter may not be carried out smoothly—the inner diameter varies, for example, of the order of as much as 5 $\mu$m along its length by a pickling operation of only 30 minutes: (e) when a plurality of tubular members are treated in lines or in series one time, the measurement values tend to become inaccurate.

SUMMARY OF THE INVENTION

With the foregoing in view, the present inventors have succeeded developing a novel apparatus for pickling the inner wall of a tubular member, in which apparatus, when the tubular member is immersed in a water tank and pickling liquid is passed through the thus-immersed tubular member to conduct continuous pickling treatment upon pickling the inner wall of the tubular member, an ultrasonic inner diameter measurement instrument and a pickling liquid-supplying mechanism are interlocked so as to stop the supply of pickling liquid by a stop signal generated automatically by the instrument as soon as the instrument detects the fact that the inner diameter of the tubular member has reached to a predetermined value.

Owing to the above apparatus, it would be theoretically possible to make the inner diameter of a tubular member uniform within the range of a few micrometers through pickling treatment of the same even if the diameter changes along its length prior to pickling treatment.

If the temperature (i.e., water temperature) in the water tank and that of the pickling liquid change from time to time, the sonic velocity would be considerably affected and precise control of the inner diameter of a tubular member would become difficult. Thus, to avoid occurrence of any difference in inner diameter along the length of the tubular member due to temperature variations, an object of this invention is to provide an apparatus in which there is provided a mechanism for showering cooling water of a temperature higher than that of water in the water tank onto the tubular member at locations in front of and behind the water tank of the pickling apparatus, thereby improving the ease and stability of correction of the inner diameter.

Another object of this invention is to provide an apparatus for pickling the inner wall of a tubular member, which apparatus is equipped with shutter mechanism for operably closing each of a pair of guiding mechanism provided in front of and behind a water tank for guiding the tubular member through the tank, thereby minimizing the variation of the level of water in the tank so as to make control of the water temperature easier and to suppress the agitation of water and thus eliminate causes for abnormal measurement values and deteriorated correction accuracy. More specifically, an inner diameter measurement instrument which makes use of an ultrasonic wave requires the water level to continuously be above the installation position of the instrument by a certain constant distance. To meet this requirement, the water tank may be enlarged or the supply of water to the water tank may be increased to avoid any considerable lowering of the water level due to the out-flow of water during the controlled pickling operation. However, the former requires a wider installation space and reders control of the water temperature difficult insofar as there is a great quantity of water in the tank. On the other hand, the latter causes violent agitation of the water in the water tank, thereby resulting in another source for the development of air bubbles. The difficulties in controlling the water temperature in the tank have been solved by the provision of the shutter mechanism as mentioned above.

Another object of this invention is to provide an apparatus for pickling the inner wall of a tubular material in which a nozzle mechanism is provided to jet out water against an ultrasonic wave generation portion of the inner diameter measurement instrument and its corresponding portion on the outer surface of the tubular member so as to remove any air bubbles which affect adversely on the accuracy of the inner diameter measurement and thus to improve its measurement accuracy.

Air bubbles in water raise a problem in general ultrasonic flaw detection or measurement of dimensions. If air bubbles stick on the surface of a tubular member to be measured or on the surface of a probe, noise signals are generated. These noise signals render not only the measurement but also the calibration inaccurate.

The generation of air bubbles cannot be avoided in the apparatus of the present invention due to the mounting and demounting of a tubular member in the water tank, agitation of water caused by the supply and discharge of water, temperature differences on the tubular member along its length or between the inner and outer walls thereof caused by the reaction heat, the quality of water, etc. This problem has been solved by the provision of the nozzle mechanism as described above.

In one aspect of this invention, there is thus provided an apparatus for pickling the inner wall of a tubular member. The apparatus includes a support table for supporting demountably the tubular member in an axially inclined position, a water tank mounted on the support table in such a way to allow the tubular member to extend therethrough, pickling liquid-supplying mechanism disposed in front of the water tank for charging a pickling liquid into the tubular member, a recovery mechanism disposed in rear of the water tank for recovering the pickling liquid which has been used and flows out from the rear end of the tubular member, and an instrument disposed in the water tank for the measurement of the inner diameter of the tubular member by virtue of an ultrasonic wave. The instrument and the pickling liquid-supplying mechanism are interlocked to control the supply of the pickling liquid.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

In the accompanying drawings.

DETAILED DESCRIPTION OF THE PREFERRED EMBODIMENTS

Figure 1:
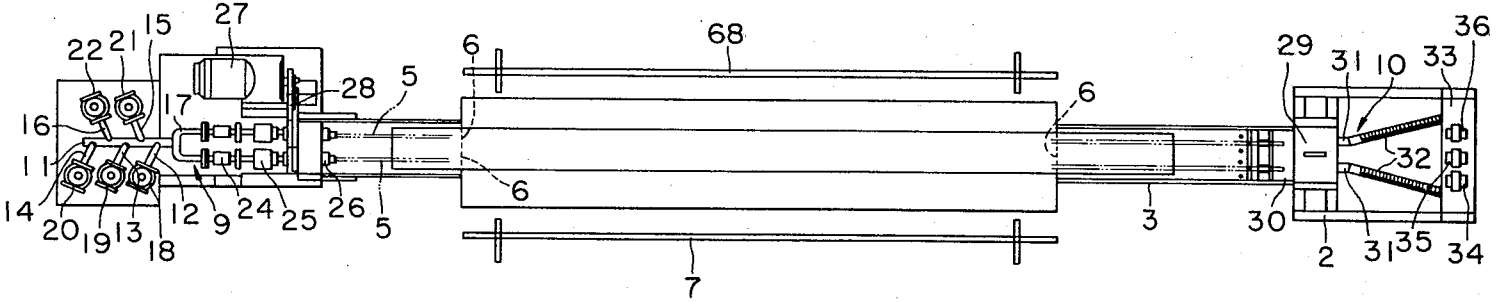
FIG. 1 is a schematic overall plan view of one embodiment of the apparatus according to this invention.

FIG. 1 through FIG. 4 show the fundamental constitution of the apparatus according to this invention. Referring to the drawings, particularly, to FIG. 1 which illustrates in plan the overall outline of the apparatus and FIG. 2 which shows in elevation the overall outline of the same apparatus, reference numeral 1 indicates a mounting table installed at the pickling liquid-supplying side while numeral 2 designates another mounting table disposed at the recovery side of the used pickling liquid. These tables 1, 2 are installed with a spacing greater than the length of a tubular member. Designated at numeral 3 is a gutter-like support table having a square U-shaped transverse cross-section and extending between and supported by the mounting tables 1, 2.

Numeral 4 indicates a water tank, which is disposed at a lengthwise middle portion of the support table 3. In the front and rear walls of the tank 4, there are formed mechanisms 6 for mounting a tubular member 5 in the water tank 4. In the illustrated embodiment, each of the mechanisms 6 take the form of an upwardly open slit.

Along the both sides of the water tank 4, there are provided loading member 7 and unloading member 68 for the tubular member 5, 5 respectively. The tubular member 5 loaded into the water tank 4 by the loading mechanism 7 is fit in the mounting mechanism 6. Now, the tubular member 5 is immersed in the water of the water tank 4. At the same time, the tubular member 5 is supported by supporting rollers 8 provided with the support table 3 at locations in front of and behind the tank 4 in an axially inclined position, more specifically, at a higher position by pickling liquid-supplying mechanism 9 and at a lower position by recovery mechanism 10 for the used pickling liquid.

Figure 2:
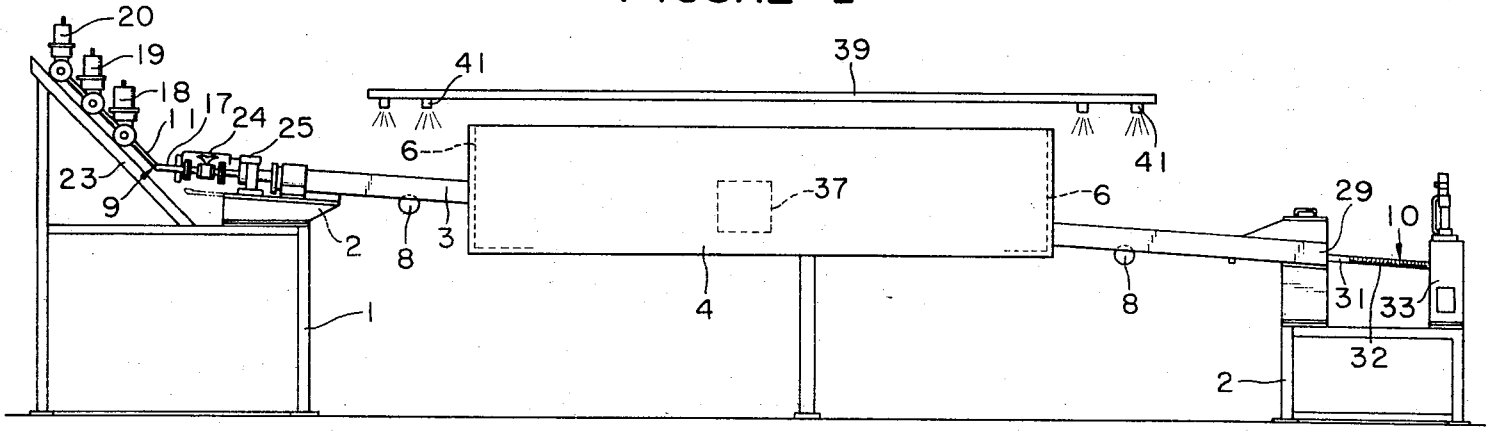
FIG. 2 is a front elevational view of the apparatus.
Figure 3:
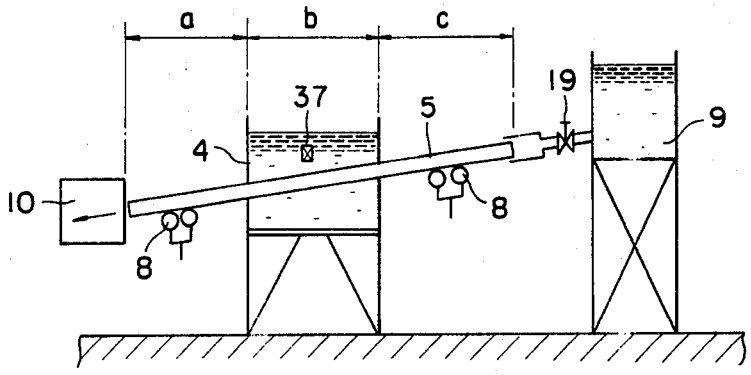
FIG. 3 is a schematic view illustrating the apparatus in a pickling operation.
Figure 4:
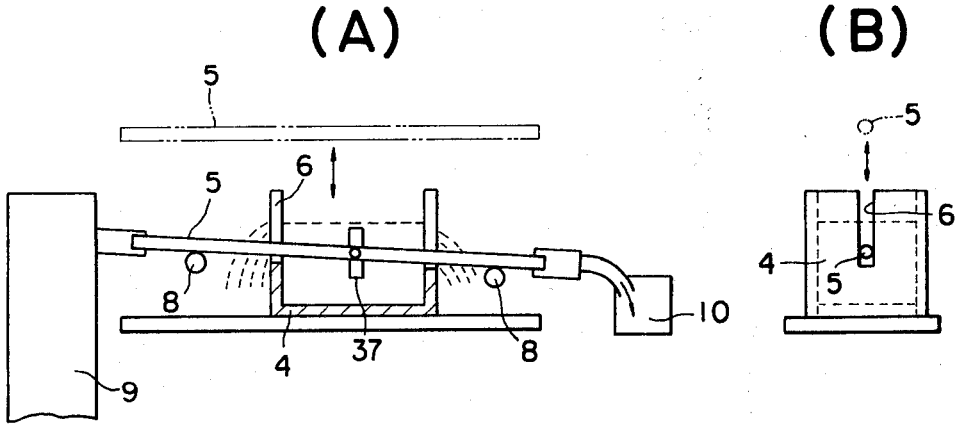
FIG. 4(A) and FIG. 4(B) are respectively a cross-sectional front elevational view and a side elevational view of the apparatus, showing the mounting and demounting operations of the tubular member respectively.

The pickling liquid-supplying mechanism 9 can feed a pickling liquid, a neutralizing liquid and rinsing water separately to the two tubular members 6 and can terminate their supply in the embodiment shown in FIG. 1 and FIG. 2. Even if the tubular members 5 are treated one by one or 3 or more tubular members 5 are pickled at once, a basically similar apparatus may be adopted.

An example of the pickling liquid-supplying mechanism 9 will now be described in detail by referring to FIG. 1 and FIG. 2. Numeral 11 indicates a main pipe which is branched into five sub-pipes 12, 13, 14, 15, 16. At the opposite end, the main pipe 11 terminates in a bifurcated communication pipe having two branch pipes 17.

The sub-pipes 12, 13, 14, 15, 16 are provided, respectively, with automatically operable closure valves 18, 19, 20, 21, 22, which are used, respectively, for the pickling liquid, for the neutralizing liquid, as an air vent, for rinsing water and for discharging liquid. The main pipe 11 is provided aslant downwardly in the direction of the flow of the pickling liquid by means of an inclined bracket 23 as shown in FIG. 2 so that no liquid would remain in the pipe 11.

Furthermore, each of the branch pipes 17 is provided with a stop valve 24 and, in the flowing direction of the pickling liquid, terminates through a rotary coupler 25 in a sleeve 26 which supports the tubular member 5 while allowing the passage of the pickling liquid thereinto.

The sleeve 26 is rotatable by a geared motor 27 through a transmission gear 28, thereby rotating the tubular member 5 supported by the support rollers 8 around its longitudinal axis as needed.

Next, the recovery mechanism 10 will be described by making reference to FIG. 1 and FIG. 2. Numeral 28 indicates a recovery flow path, which is formed of a receiver 30 provided at the rear end portion of the gutter-like support table 3, a bifurcated pipe having two branch pipes 31, flexible communication pipes 32 connected to their corresponding branch pipes 31, a recovery compartment 33, and closure valves 34, 35, 36 each of which is actuated by a cylinder (not shown).

The above pickling liquid-supplying mechanism 9 and recovery mechanism 10 have been illustrated merely as examples. Many modifications and changes may be effected insofar as the pickling liquid can be fed into the tubular member 5 mounted in the water tank 4 at one end thereof and recovered at the other end thereof as well as liquids of different types can be supplied and recovered separately.

Designated by numeral 37 is an inner diameter measurement instrument having an ultrasonic wave generation portion 38 (see, FIG. 14 through FIG. 16) shown as a probe sensor. Instrument 37 is disposed opposite to each tubular member 5 mounted in an inclined position and under immersed conditions in the water tank 4. More specifically, each inner diameter measurement instrument 37 is detachably converted the inner wall of the water tank 4 or the like at a height below the water level by a predetermined distance (for example, 50 mm). Each inner diameter measurement instrument 37 is interlocked with the pickling liquid-supplying mechanism 9, more specifically, with the closure valve 19 for the pickling liquid so as to automatically stop the supply of the pickling liquid when the inner diameter of the tubular member 5 reaches a predetermined value through pickling (a reduction in thickness due to the pickling).

Figure 5:
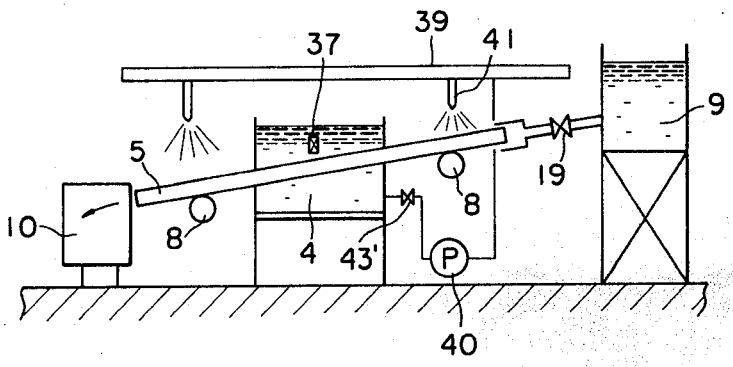
FIG. 5 a schematic view of another embodiment of the apparatus of this invention in a pickling operation, which apparatus is equipped with a shower mechanism for spraying cooling water onto the tubular member.

In FIG. 2 and FIG. 5, numeral 39 indicates a mechanism for spraying cooling water, which enables showering cooling water of a temperature higher than the water in the water tank 4 through shower nozzles 41 by a pump 40, etc. Namely, the shower nozzles 41 are located in front of and to the rear of the water tank 4, thereby enabling showering cooling water against the front and rear portions of the tubular members 5, which portions are exposed from the front and rear walls of the tank 4.

Figure 17:
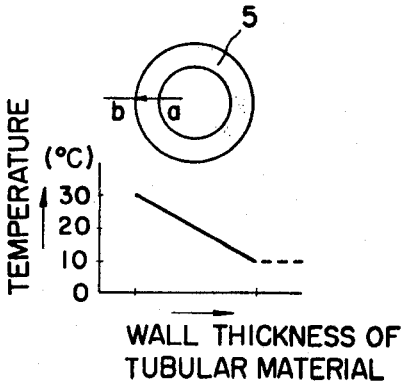
FIG. 17 is an explanatory illustration showing the gradient of temperature difference between the inner and outer walls of the tubular member under pickling treatment.
Figure 18:
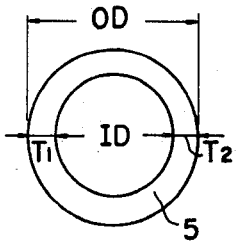
FIG. 18 is an explanatory illustration showing the wall thickness, outer diameter and inner diameter of the tubular member.

FIG. 17 and FIG. 18 are now referred to. When the inner wall of the tubular member 5 is finished so as to have a mirror-like surface by pickling the same, the inner wall is heated to a certain high temperature owing to reaction heat. On the other hand, the outer wall of the tubular member 5 is kept cooler than the inner wall as the outer wall is in contact with water in the water tank 4. Thus, there is a temperature gradient between the inner and outer walls of the tubular member 5 as shown in FIG. 17.

Such a temperature gradient is rather small in general ultrasonic measurements and, therefore, no problem or inconvenience would arise from a practical point of view. However, a pickling operation develops reaction heat and the temperature gradient becomes greater. This is certainly of a serious problem. If the temperature difference between the inner and outer walls of the tubular member 5 changes from time to time, the sonic velocity would be affected by such a temperature change and it would become difficult to precisely control the sonic velocity. As depicted in FIG. 18, the inner diameter of a tubular member is represented by an equation: $ID=OD-(T_1+T_2)$, wherein ID and OD mean respectively, the inner and outer diameters of the tubular member, while $T_1$ and $T_2$ denote respectively the wall thicknesses of the tubular member at opposition locations on a common diameter. Therefore, if the measurement of the basic $T_1$ and $T_2$ thicknesses should become inaccurate, the inner diameter ID would obviously become inaccurate.

The measurement of the inner diameter of the tubular member 5 is affected particularly by temperature variations in its lengthwise direction. The inner diameter of the tubular member 5 would become different at the inside section b of the water tank 4 as well as the outside sections a and d due to temperature differences present thereamong (see, FIG. 3).

By providing a mechanism 39 for showering cooling water shown in FIG. 2 and FIG. 5, which mechanism 39 has shower nozzles 41 in front of and to the rear of the water tank 4, it has become feasible to prevent positional temperature variation at the inside section b as well as the outside sections a and c in the lengthwise direction of the tubular members 5. Owing to the provision of the showering mechanism 39, the temperature of the tubular member 5 has become substantially uniform along the entire length thereof. Thus, the variation of the inner diameter along the length of a tubular member has been eliminated by showering warm water through the shower nozzles 41, thereby improving the ease and accuracy of the control of the inner diameter. Namely, the temperature of the water tank 4 with the ultrasonic probes sensors 37 installed therein is maintained at a temperature that is most easy to maintain throughout all seasons, and the front and rear portions of the tubular member 5, which portions are located outside the water tank 4, are showered with water of a temperature closer to the temperature of the water in the water tank 4. The temperature of the showering water is selected so as to make the inner diameter of the tubular member 5 uniform along the entire length thereof.

In other words, in order to avoid the occurrence of a temperature difference between the inner and outer walls of the tubular member 5 (namely, in the direction of the wall thickness) due to reaction heat upon pickling the inner wall of the tubular member 5 and inaccurate ultrasonic measurement of the dimension due to the temperature difference, the water temperature of the water tank 4 is maintained near a temperature to which the inner wall of the tubular member 5 is heated owing to the reaction heat and both end portions of the tubular member 5 are showered with water of such a temperature that the inner walls of the tubular member 5 at both end portions thereof would have the same temperature as its middle portion immersed in the water tank 4.

Figure 9:
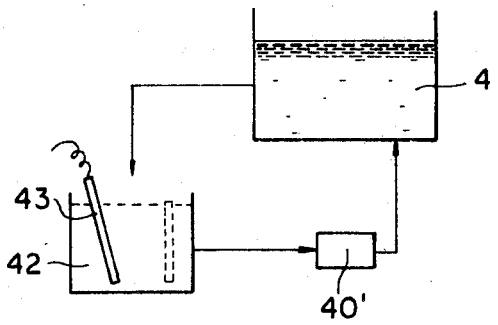
FIG. 9 and FIG. 10 illustrate diagrammatically two different embodiments of the water supply mechanism for the water tank.
Figure 10:
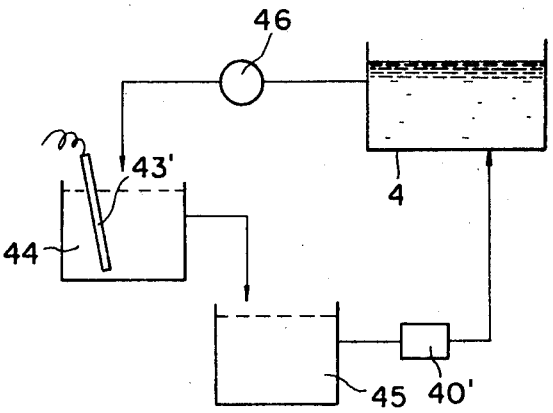

Water is supplied to the water tank 4 by a water-supplying mechanism which is exemplified in FIG. 9 and FIG. 10. Numeral 42 indicates a heating tank which serves also as a reservoir for heated water. Heating tank 42 includes a heater 43. Water, which has been heated in the heating tank 42 and stored there, is supplied to the water tank 4 through a pump 40' and a valve 43' shown in FIG. 5. The effluent water from the water tank 4 is recycled through the heating tank 42 and the valve 43. On the other hand, the example shown in FIG. 10 includes a heating tank 44 and reservoir 46 as separate tanks. The heated water is supplied by the pump 40' and discharged by a pump 46. In the arrangement illustrated in FIG. 9, water is heated and directly supplied to the tank 4. Thus, the temperature of the water changes considerably above and below a predetermined temperature. Accordingly, it was impossible or at least difficult to control the water temperature, for example, within the range of ±4° C. According to the arrangement depicted in FIG. 10, the reservoir 45 serves to buffer the temperature variation and the temperature variation is inhibited.

In the basic example shown in FIG. 4(A) and FIG. 4(B), the mounting mechanism 6 at both the front and rear walls of the water tank 4 are always kept open. Therefore, the water level in the tank 4 varies considerably, thereby making it difficult the control dipping of the inner diameter measurement instrument 37 at a constant depth in the water. As described in the preamble of this specification, the control of water temperature would become more difficult as the volume of the water increased, and more air bubbles would be formed as the supply of water is increased in quantity.

Figure 6:
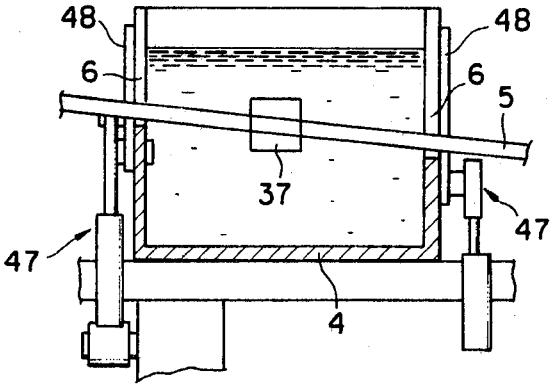
FIG. 6 is a cross-sectional front elevational view of another embodiment of the apparatus according to the present invention, which apparatus is provided with shutter mechanism at each of the mounting mechanism formed in the front and rear walls of the water tank.
Figure 7:
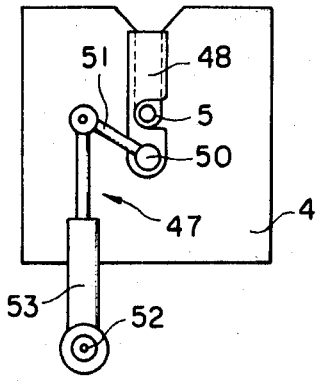
FIG. 7 and FIG. 8 show the closing and opening operations of the shutter mechanism respectively.
Figure 8:
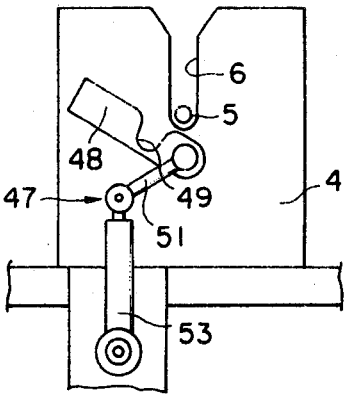

Therefore, in the present invention, shutter mechanisms 47 are incorporated to operably close the mounting mechanisms 6 provided at the front and rear walls of the water tank 4 as illustrated in FIG. 6 through FIG. 8. The shutter mechanism 47 is formed of a shutter plate 48 having an area sufficient to close the mounting mechanism 6. Shutter plate 48 defines a rounded indentation to receive the tubular member 5 when the shutter plate is brought into position for closing the mounting mechanism 6. The shutter plate 48 is turnable using a pivot pin 50 as its fulcrum. Furthermore, an arm 51 extending from the shutter plate 48 is pivotally connected to the free end of a piston rod of an expansion cylinder 53 which is in turn pivotally secured to the stationary side. In the illustrated embodiment, the shutter plate 48 opens by retraction of the cylinder 53 while it closes by an expansion of the cylinder 53. The shutter mechanism 47 and measurement instruments 37 are associated so as to generate a signal for initiating a pickling operation and another signal for starting the measurement of the inner diameters of the tubular members 5 when the shutter plates 48 are closed and the inner diameter measurement instruments 37 are immersed at a predetermined depth. Namely, while opening the shutter plates 48, the tubular members 5 are fitted in their respective mounting mechanism 6. Upon closing the shutter plates 48 thereafter, prescribed signal is generated to start a pickling operation. When the inner diameter measurement instruments 37 detect that pickling has proceeded to a predetermined inner diameter, signals are generated from the instruments 37 and their corresponding valves 19 for the pickling liquid are closed automatically. Thereafter, the operation mode is changed to, for example, water rinsing, and upon completion of specified water rinsing, a signal is sent to the cylinders 53 to open the shutter plates 48 and to demount the tubular members 5. These operations are automatically controlled. A rotary drive mechanism may be employed for operating the shutter plates 48.

As mentioned in the preamble of the present specification, the problem of air bubbles would unavoidably arise when ultrasonic inner diameter measurement instruments 37 are employed in a pickling apparatus. If such air bubbles stick on an ultrasonic wave generation portion and the outer surface of a tubular material, they become a source of measurement error. To solve the above problem, jet nozzle mechanism 54 is provided for each ultrasonic wave generation portion 38 and its corresponding outer surface of the tubular member 5 in the apparatus of this invention as shown in FIG. 14.

Figure 14:
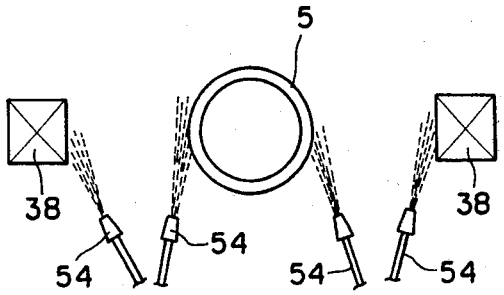
FIG. 14 is a schematic illustration showing the nozzles in operation.

In the embodiment of FIG. 14, a pair of ultrasonic wave generation portions 38 are provided in the form of probe sensors. Only one generation portion may also be used. Nozzle mechanism 54 are provided directing their respective generation portions 38 and their corresponding locations on the outer surfaces of the tubular member 5. Thus, air bubbles are removed and the problem of unstable sonic velocity caused by such air bubbles (which leads to measurement errors) is avoided. It is desirous to incorporate in the free end of each nozzle mechanism 54 a filter of the order of 20 micrometers or so in order to prevent any solid substances from jetting out together with water.

Figure 15:
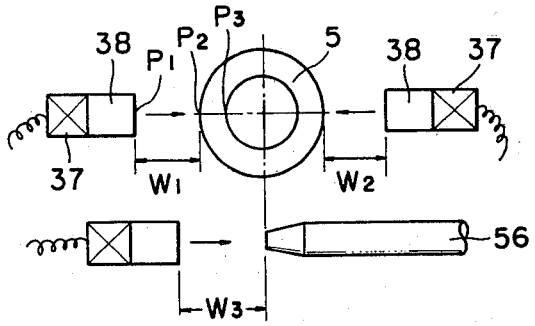
FIG. 15 and FIG. 16 schematically illustrate the relationship between the tubular member and probe sensor.
Figure 16:
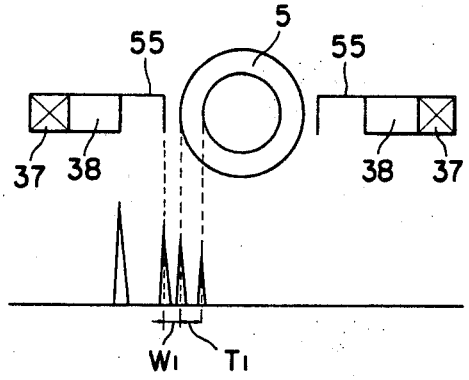

In FIG. 15 and FIG. 16, there are shown by way of example the following additional mechanism to the inner diameter measurement means 37 for improving the measurement accuracy further. When obtaining such products as, for example, cladding tubes for nuclear fuel through the application of the errosion action by an acid as mentioned above, about 105 Kcal is generated to make the inner surface of each tubular member smooth and to continuously control its inner diameter with an accuracy on the order of ±1-2 μm. Accordingly, a temperature difference is developed between the inner and outer walls of the tubular member within the water tank (see, FIG. 17).

This heat also takes a part in the development of a temperature difference between the outer surface $P_2$ of the tubular member and the surface $P_1$ of the ultrasonic wave generation portion 38, as shown in FIG. 15. This temperature difference is always unstable.

Even if the shower nozzles 41 are provided as illustrated in FIG. 5, the temperature difference between $W_1$ and $W_2$ in FIG. 15 would cause a serious problem where accuracy of the order of ±1−2 micrometers is required. The above temperature difference cannot be ignored as the sonic velocity is affected by water temerature and the distance between an ultrasonic wave generation portion 38 and its corresponding point on the outer surface of a tubular member 5. Moreover, the above-mentioned $W_1$, $W_2$ can not be freely shortened insofar as they are determined by the characteristics of a probe sensor to be employed.

Accordingly, as shown in FIG. 16, a target, namely, a reflector plate 55 is provided at the free end of each ultrasonic wave generation portion 38 so as to practically shorten both $W_1$, $W_2$ and carry out the measurement on the basis of a reflection wave from the surface of the tubular member 5. In other words, $W_3$ in FIG. 15 has been made to satisfy an equation, $W_3 = W_1 + W_2$. It should be furher noted that numeral 56 indicates a slug for temperature compensation. In FIG. 16, $T_1$ and $W_1$ indicates the wall thickness and distance between the reflector plate 55 and the outer surface of the tubular member 5 respectively. Owing to the provision of such a reflector plate 55, the following advantage has been derived.

The change of the sonic velocity (or the change of time) is generally determined supposing $\alpha$ (rate of change of water temperature)=0.2%/°C. Now, the phenomenon of internal heat generation caused by pickling treatment is considered. Supposing the temperature difference when the aforementioned reflector plate 55 is not provided, in other words, the temperature difference over the distance $W_1$, namely, between the positions $P_1$ and $P_2$ or between the positions $P_2$ and $P_3$ is 10° C., the theoretical change $K_1$ where the reflector plate 55 is provided and $W_1 = W_2 = 1$ mm and $W_3 = 2$ mm is calculated as follows:

$$K_1 = 10°C. \times (2/1000) \times 2 \text{ mm} = 0.04 \text{ mm } (40\ \mu m)$$

Supposing the temperature difference is 1° C., $$K_2 = 1° C. \times (2/1000) \times 2 \text{ mm} = 0.004 \text{ mm } (4\ \mu m).$$

Since the accuracy of ±1 μm has actually been accomplished, the error has been reduced to 1/40. If the reflector plate 55 is not provided and $W_1$, $W_2$ are both hypothetically set at 4 mm, the ultrasonic control may not be satisfactorily applied to cladding tubes of zircaloy even if the water temperature is strictly controlled within ±1° C. Thus, the provision of the reflector plate 55 makes the ultrasonic control adequate for the measurement of the inner diameter of such a zircaloy cladding tube.

Figure 11:
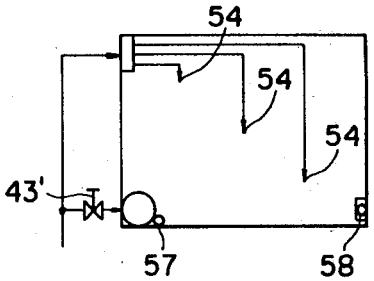
FIG. 11 through FIG. 13 are schematic plan views showing the positional relationship among the water inlets, inner diameter measurement instruments, nozzles for removing air bubbles, and tubular members.
Figure 12:
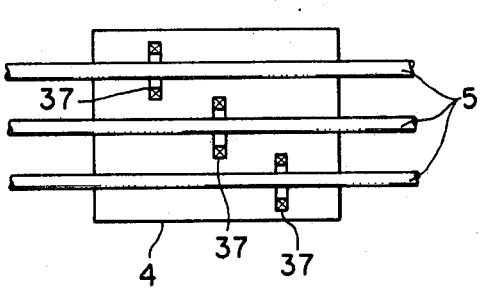
Figure 13:
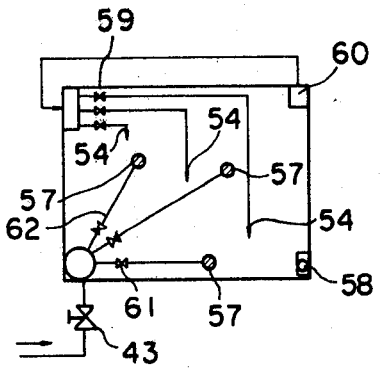

In FIG. 11 through FIG. 13, there is shown by way of example a mechanism to solve the problem of temperature differences among three tubular members 5, which differences tend to occur when their inner walls are pickled simultaneously by disposing the tubular members 5 parallely through the tank 4.

Comparative examples are shown in FIG. 11 and FIG. 12. Namely, three tubular members 5 are mounted in the water tank 5. The inner diameter measurement instruments 37, in other words, probe sensors are arranged as shown in FIG. 12 and the jet nozzles 54 are disposed as illustrated in FIG. 11. The water from the pump is supplied into the water tank 4 through a water inlet 57 and the water is allowed to over-flow from an over-flowing portion 58. The flow of water within the water tank 4 is susceptible of becoming non-uniform due to reduction in flow rate of water to be jetted out from the jet nozzles 54, which reduction may be caused even by a slight clogging of the filters provided therein, or the long distance between the water inlet 57 and each of the ultrasonic wave generation portions 38. Therefore, temperature differences would unavoidably occur in the vicinity of each ultrasonic wave generation portion 38.

Thus, as shown in FIG. 13, the variation of flow rate of each of the jet nozzles 54 due to its clogging is prevented by supplying water through a pump 60 and providing a control valve 59. In addition, the water inlet 57 is distributed to the positions in FIG. 13 by providing a branched pipe which has branch pipes 62 each equipped with a control valve 61 so that the temperature variation around each of the ultrasonic wave generation portions 38 can be reduced to ±1° C. It was difficult to equialize the water temperature near each ultrasonic wave generation portion 38 for the reasons mentioned above, coupled with the fact that the water tank 4 is rectangular. This problem has been solved by evenly distributing the water to be supplied to the tank 4 as described above.

Since the tubular members 5 are mounted and immersed in the water of the water tank 4 in axially inclinded positions and ultrasonic inner diameter measurement instruments 37 are provided within the water and interlocked with the pickling liquid-supplying means 9, the supply of pickling liquid can be automatically stopped as soon as the inner diameters of the tubular members 5 have reached a predetermined value in the course of a continuous pickling operation thereof, thereby providing tubular members having a uniform and mirror-finished inner wall.

Owing to the provision of the mechanism 39 for showering cooling water in front and rear of the water tank 4, it has become possible to solve the problem that the inner diameter of a tubular member varies by pickling along the length thereof due to temperature variations along the length of the tubular member.

The provision of the operably closable shutter mechanism 47 at the mounting and demounting portions 6 of the water tank 4 permits maintaining the water level in the tank 4 at a predetermined level. It is also possible to minimize the flow of water within the tank 4, thereby inhibiting generation of air bubbles which adversely affect on the measurement of the inner diameter of a tubular material and making the accuracy of an ultrasonic measurement of the inner diameter improved.

Furthermore, the nozzles 54 can remove air bubbles stuck on the ultrasonic wave generation portions 38 and the outer surfaces of the tubular members. This allows precise measurement of the inner diameters of such tubular members by virtue of an ultrasonic wave.

As has been described, the present invention brings about, inter alia, advantages led by the realization of pickling of the inner wall of a tubular member made of zirconium or its alloy and intended for use as a cladding tube for nuclear fuel and, in addition, by the realization of stricter finishing even for stainless tubes.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. An apparatus for pickling the inner water of at least one tubular member, comprising;

a support table for demountably supporting the tubular member in an axially inclined position;

a water tank mounted on the support table for allowing the tubular member to extend therethrough;

pickling liquid-supplying means operatively associated with the water tank for charging a pickling liquid into the tubular member;

recovery means disposed in rear of the water tank for recovering the pickling liquid which has been used and has flowed out from the rear end of the tubular member; and means disposed in the water tank for measuring the inner diameter of the tubular member by ultrasonic waves, said measuring means and said pickling liquid-supplying means being interlocked for controlling the supply of the pickling liquid.

2. The apparatus as claimed in claim 1, wherein said pickling liquid-supplying means further comprises a main pipe and a plurality of sub-pipes so as to supply the plurality of treatment liquids of different types independently from their respective sub-pipes into the tubular member through the main pipe in series.

3. The apparatus as claimed in claim 2, wherein said at least one tubular member further comprises a plurality of tubular members, said pickling liquid-supplying means further comprises a plurality of branch pipes and a communication pipe branched into said plurality of branch pipes, said communication pipe being positioned downstream of the main pipe so as to pickle the plurality of tubular members simultaneously.

4. The apparatus as claimed in claim 3, further comprising a rotary coupler wherein each of said branch pipes further comprises a sleeve through at which each of said branch pipes terminate said rotary coupler so as to detachably hold the tubular member.

5. The apparatus as claimed in claim 4, further comprising a gear motor and a transmission gear wherein said sleeve is rotatable by said gear motor through said transmission gear for allowing the tubular member to rotate about the longitudinal axis thereof.

6. The apparatus as claimed in claim 1, further comprising shower means for spraying a shower of water onto portions of the tubular member, said portions extending outside in front of and to the rear of the water tank, so as to make the temperatures of the inner walls of the portions substantially identical to the temperature of the inner wall of the remaining portion which is located within the water tank.

7. The apparatus as claimed in claim 6, wherein the shower of water is of a temperature higher than the temperature of water in the water tank.

8. The apparatus as claimed in claim 1, further comprising a pair of mounting means for guiding the tubular member through the water tank, said means being provided on both the front and rear walls of the water tank, and a pair of shutter means provided at the front and rear walls of the water tank so as to operably close the respective mounting means of said pair of mounting means.

9. The apparatus as claimed in claim 8, wherein said mounting means further comprise an upwardly open slit formed in its respective wall of the water tank.

10. The apparatus as claimed in claim 9, wherein the shutter means each further comprise a shutter plate having an area sufficient to close said slit, said shutter plate defining a rounded indentation to receive the tubular member when the shutter plate is brought into a position for closing its corresponding slit, and means for turning said shutter plate about one end portion thereof.

11. The apparatus as claimed in claim 10, wherein the shutter plates each further comprise hydraulic cylinders for operation thereof interlocked with the pickling-liquid supplying means.

12. The apparatus as claimed in claim 1, further comprising nozzle means for jetting out water against an ultrasonic wave generation portion of the measuring means and a corresponding portion on the outer surface of the tubular member so as to remove air bubbles therefrom.

13. The apparatus as claimed in claim 12, wherein said nozzle means further comprises a filter positioned at the free end thereof for preventing any solid substance from being jetted out together with water.

14. The apparatus as claimed in claim 1, wherein said measuring means further comprises an ultrasonic probe sensor.

15. The apparatus as claimed in claim 14, further comprising a reflector plate operatively connected with the ultrasonic wave generation portion of the probe sensor at the free end thereof so as to practically shorten the distance between the generation portion and the outer surface of the tubular member for minimizing the measurement error which is caused by variation of the water temperature.

16. The apparatus as claimed in claim 1, further comprising a water-heating tank for heating water circulated from the water tank and reservoir means for storing the thus-heated water and supplying the same to the water tank.

17. The apparatus as claimed in claim 16, wherein the water tank further comprises a branched water inlet pipe having a plurality of branch pipes for supplying the thus-heated water from the reservoir means minimizing the water temperature variation within the water tank.

* * * * *

UNITED STATES PATENT AND TRADEMARK OFFICE

CERTIFICATE OF CORRECTION

PATENT NO. : 4,398,552

DATED : AUGUST 16, 1983

INVENTOR(S) : TANAKA, YOSHIRO; FUJII, NORITSUGU; AKAGI, KAZUO and KABUSHIKI KAISHA KOBE SEIKO SHO It is certified that error appears in the above-identified patent and that said Letters Patent is hereby corrected as shown below:

On the Title Page, column 1, line 4, delete "MATERIAL" and insert therefor --MEMBER--;

In the Abstract, line 7, delete "mechanism" and insert therefor --mechanism(s)--;

In column 1, line 3, delete "MATERIAL" and insert therefor --MEMBER--;

In column 1, line 16, delete "member" and insert therefor --members--;

In column 1, line 17, delete "member" and insert therefor --members--;

In column 1, line 52, delete "develope" and insert therefor --develop--;

In column 2, line 6, delete "ingeneously" and insert therefor --ingeniously--;

In column 2, line 34, after "succeeded" insert --in--;

In column 3, line 18, delete "reders" and insert therefor --renders--;

In column 4, line 20, after "FIG 5" and insert --is--;

In column 4, line 26, after "with" insert --a--;

In column 6, line 8, after "converted" insert --to--;

UNITED STATES PATENT AND TRADEMARK OFFICE

CERTIFICATE OF CORRECTION

PATENT NO. : 4,398,552

DATED : AUGUST 16, 1983

INVENTOR(S) : TANAKA, YOSHIRO; FUJII, NORITSUGU; AKAGI, KAZUO and KABUSHIKI KAISHA KOBE SEIKO SHO It is certified that error appears in the above-identified patent and that said Letters Patent is hereby corrected as shown below:

In column 8, line 19, delete "a" before "pickling operation";

In column 8, line 26, after "thereafter," insert --a--;

In column 8, line 27, delete "a" before "pickling operation";

In column 8, line 29, delete "detect" and insert --detects--;

In column 8, line 54, delete "mechanism" and insert therefor --mechanisms--;

In column 8, line 65, delete "mechanism" and insert therefor --mechanisms--;

In column 9, line 1, delete "errosion" and insert therefor "erosion";

In column 9, line 33, delete "furher" and insert therefor --further--;

In column 10, line 34, delete "equialize" and insert therefor --equalize--;

In column 10, line 42, delete "clinded" and insert therefor --clined--;

In column 10, line 45, delete "means" and insert therefor --mechanism--;

UNITED STATES PATENT AND TRADEMARK OFFICE

CERTIFICATE OF CORRECTION

PATENT NO. : 4,398,552

DATED : AUGUST 16, 1983

INVENTOR(S) : TANAKA, YOSHIRO; FUJII, NORITSUGU; AKAGI, KAZUO and KABUSHIKI KAISHA KOBE SEIKO SHO It is certified that error appears in the above-identified patent and that said Letters Patent is hereby corrected as shown below:

In column 11, line 16, delete "water and insert therefor --wall--.

Signed and Sealed this

*Third* Day of *April 1984*

[SEAL]

*Attest:*

GERALD J. MOSSINGHOFF

*Attesting Officer*

*Commissioner of Patents and Trademarks*